US007051391B2

(12) United States Patent
Wang

(10) Patent No.: US 7,051,391 B2
(45) Date of Patent: May 30, 2006

(54) EMERGENCY ESCAPE TOOL FOR VEHICLE

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 142 days.

(21) Appl. No.: 10/671,487

(22) Filed: Sep. 29, 2003

(65) Prior Publication Data

US 2005/0066447 A1 Mar. 31, 2005

(51) Int. Cl.
*B26B 11/00* (2006.01)

(52) U.S. Cl. ..... 7/158; 7/144

(58) Field of Classification Search ..... 7/100, 7/143, 144, 158; 362/119–120
See application file for complete search history.

(56) References Cited

U.S. PATENT DOCUMENTS 3,085,150 A * 4/1963 Bautsch ..... 362/200
4,363,147 A * 12/1982 Deweese ..... 7/158
5,251,351 A * 10/1993 Klotz ..... 7/100
5,642,567 A * 7/1997 Lin ..... 30/366
5,903,942 A * 5/1999 Hasegawa ..... 7/144
5,952,916 A * 9/1999 Yamabe ..... 340/468
6,454,430 B1 * 9/2002 Lin ..... 362/119
6,574,816 B1 * 6/2003 Yu Chen ..... 7/100
6,592,236 B1 * 7/2003 Lin ..... 362/119
6,666,566 B1 * 12/2003 Uke ..... 362/202
6,782,576 B1 * 8/2004 Valencic et al. ..... 7/158

* cited by examiner

*Primary Examiner*—Alan Cariaso
*Assistant Examiner*—Jason Han
(74) *Attorney, Agent, or Firm*—Bacon & Thomas PLLC

(57) ABSTRACT

An emergency escape tool for helping people escaping from a vehicle while emergency has a member on which has a hole and a recess. The main member is provided with a hammer and a cutting device respectively at opposite ends thereof and two covers detachably mounted on the main member to shield the hammer and the cutting device. A whistle is received in the hole of the main member on which has a light emitting device. A clip and a holder are mounted on the main member to fasten the main member on a seat belt of the vehicle.

10 Claims, 5 Drawing Sheets

EMERGENCY ESCAPE TOOL FOR VEHICLE

BACKGROUND OF THE INVENTION

1. Field of the Invention

The present invention relates to a tool, and more particularly to a tool for helping people escaping from a vehicle while emergency.

2. Description of the Related Art

While a car accident happens, driver and passengers have to release the seat belts and open the doors for escape from the car. If the car has serious damage, the seat belts might jam and the door might be unable to be opened such that people in the car cannot escape.

FIG. 7 shows a conventional emergency escape tool 70 having a hammer 71 on a handle of which a clipper 72 is detachably mounted. While the doors are unable to open, people break the windows by the hammer 71 and cut the seat belt off by the clipper 72.

FIG. 8 shows another conventional tool, which has a hammer 81, a cutting device 82, a whistle 83, a sticking device 84 and a lighting device 85. Such tool has several functions to be operated by people but still has a problem that the cutting device 82 is easily damaged when people hammer the windows by the hammer 81.

People grip the aforesaid tools in the way of gripping a hammer such that people have to swing the forearm for a large distance to break the window. But there is not enough space in the car for a sufficient swing of the hammer.

SUMMARY OF THE INVENTION

The primary objective of the present invention is to provide an emergency escape tool, which helps people in a vehicle to escape easily after an accident has happened.

The secondary objective of the present invention is to provide an emergency escape tool, which further has functions of lighting, noising and storage.

According to the objective of the present invention, an emergency escape tool comprises a main member, a cutting device having a blade which is provided on an end of the main member, and a hammer provided on the main member at an end opposite from the cutting device.

DETAILED DESCRIPTION OF THE INVENTION

Figure 1:
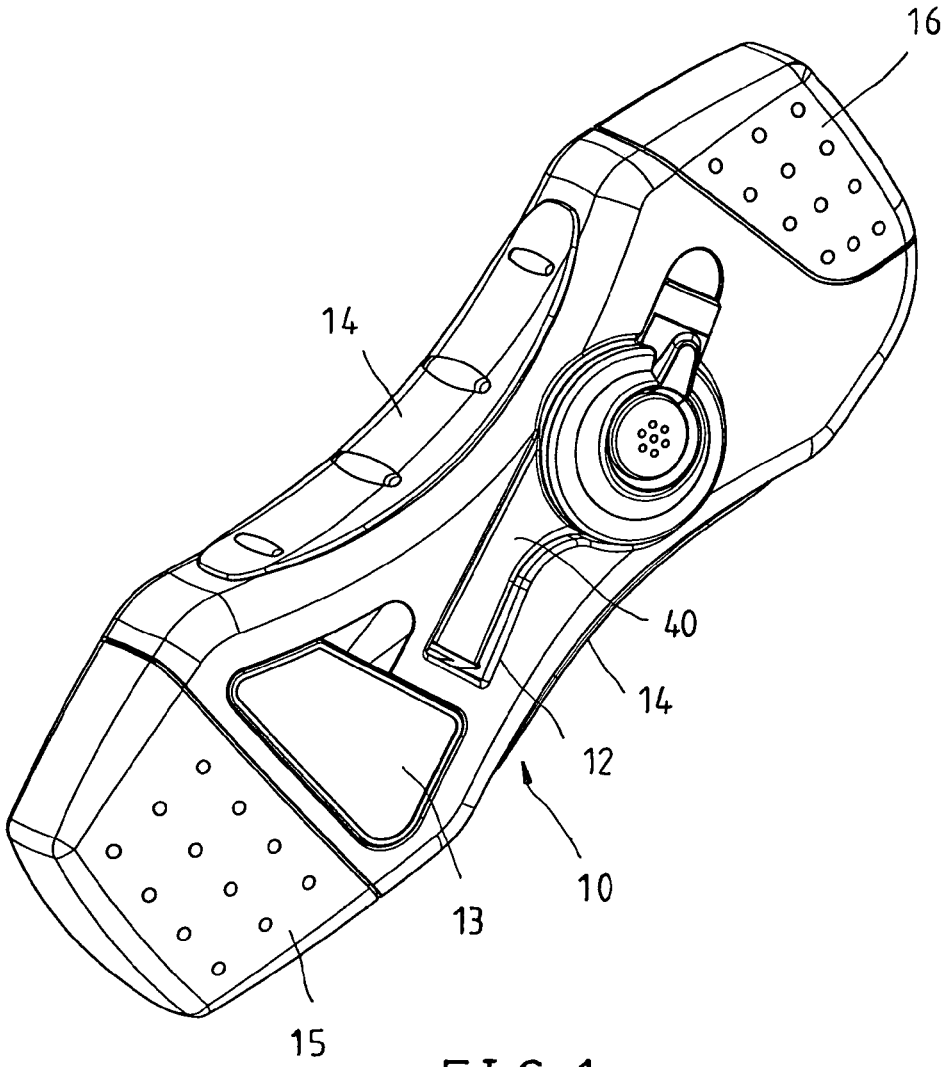
FIG. 1 is a perspective view of a preferred embodiment of the present invention.
Figure 2:
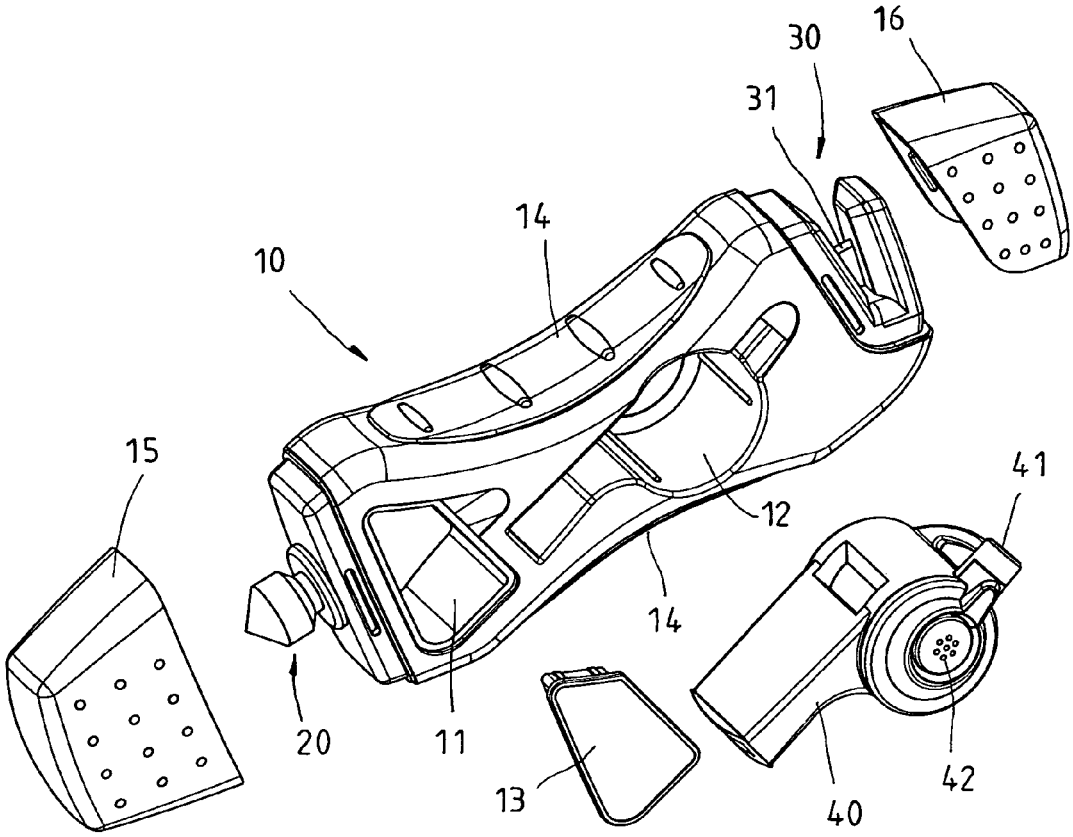
FIG. 2 is an exploded view of the preferred embodiment of the present invention.

As shown in FIG. 1 and FIG. 2, an emergency escape tool for vehicles of the preferred embodiment of the present invention comprises:

A main member 10 has a recess 11 and a hole 12, wherein the recess 11 is able to store medicines, emergency cards and so on, and a cover 13 is detachably mounted on the main member 10 to cover the recess 11. The main member 10 is provided with two pieces 14 respectively on opposite sides thereto to allow for gripping the main member comfortably and with the function of skidproof.

A hammer 20 is mounted on an end of the main member 10. The hammer 20 has an impacting portion that is substantially parallel to an elongated axis of the main member 10. A cover 15 is detachably mounted on the end of the main member 10 to shield the hammer 20.

A cutting device 30 has a blade 31 mounted on the main member 10 at the end opposite from the hammer 20. The blade 31 has a cutting portion that is substantially perpendicular to the elongated axis of the main member 10. A cover 16 is detachably mounted on the main member 10 to shield the blade 31.

A whistle 40 is received in the hole 12 of the main member 10. The whistle 40 is provided with a light emitting device 41 and a button 42 is mounted on the whistle 41 to be pressed to turn the light emitting device 42 on and off.

Figure 6:
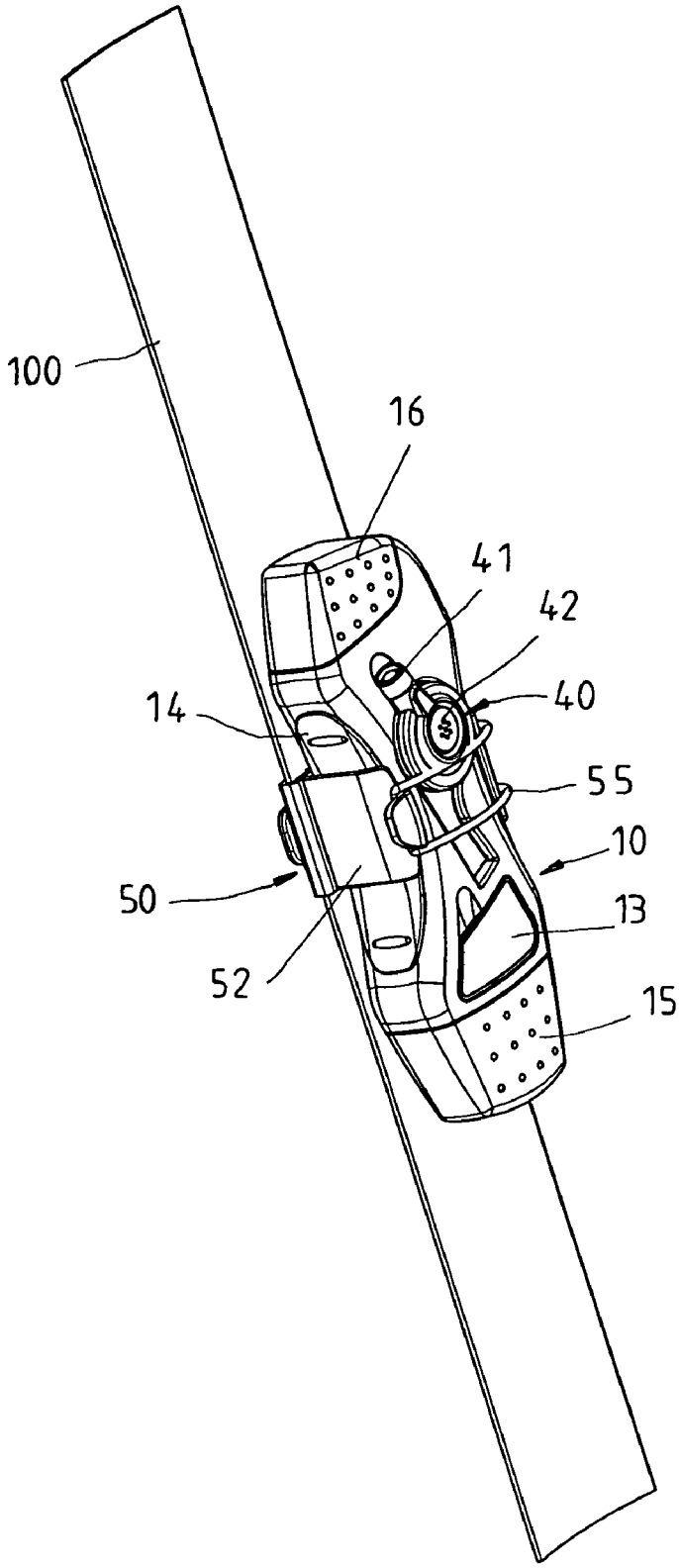
FIG. 6 is a perspective view, showing the emergency escape tool being nounted on the seat belt of the vehicle.
Figure 7:
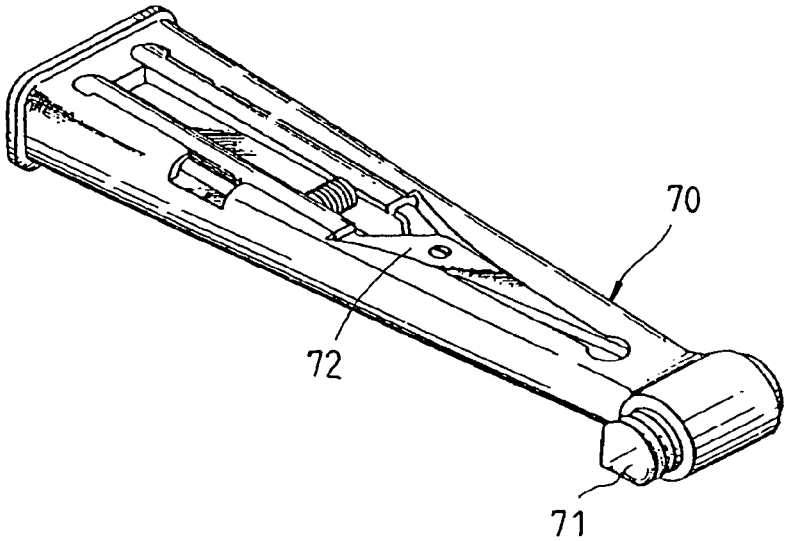
FIG.7 PRIOR ART
FIG. 7 is a perspective view of the first type of the prior art.
Figure 8:
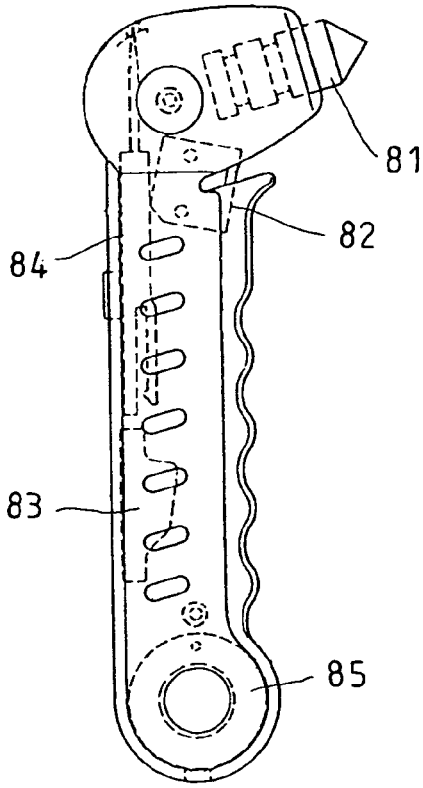
FIG.8 PRIOR ART
FIG. 8 is a perspective view of the second type of the prior art.

A clip 50 is detachably mounted on a back of the main member 10 to fasten the emergency escape tool of the present invention on a seat belt 100 of a vehicle as shown in FIG. 6.

Figure 3:
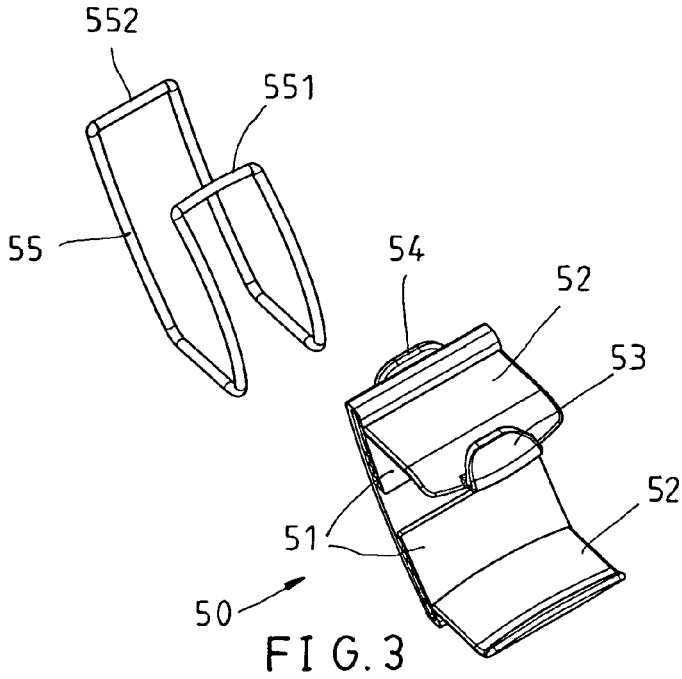
FIG. 3 is a perspective view of the clip and the holder.
Figure 4:
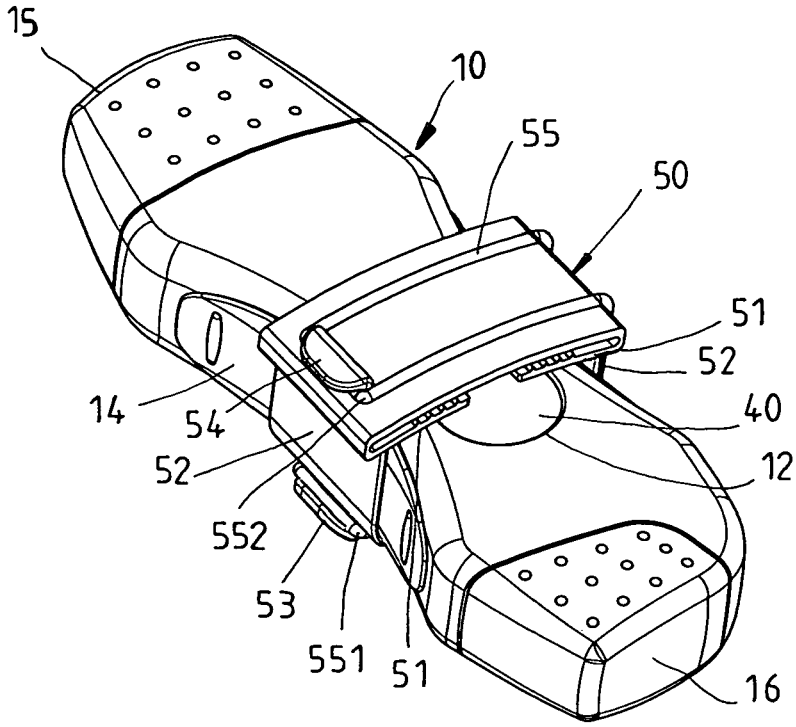
FIG. 4 is a front perspective view of the preferred embodiment of the present invention.
Figure 5:
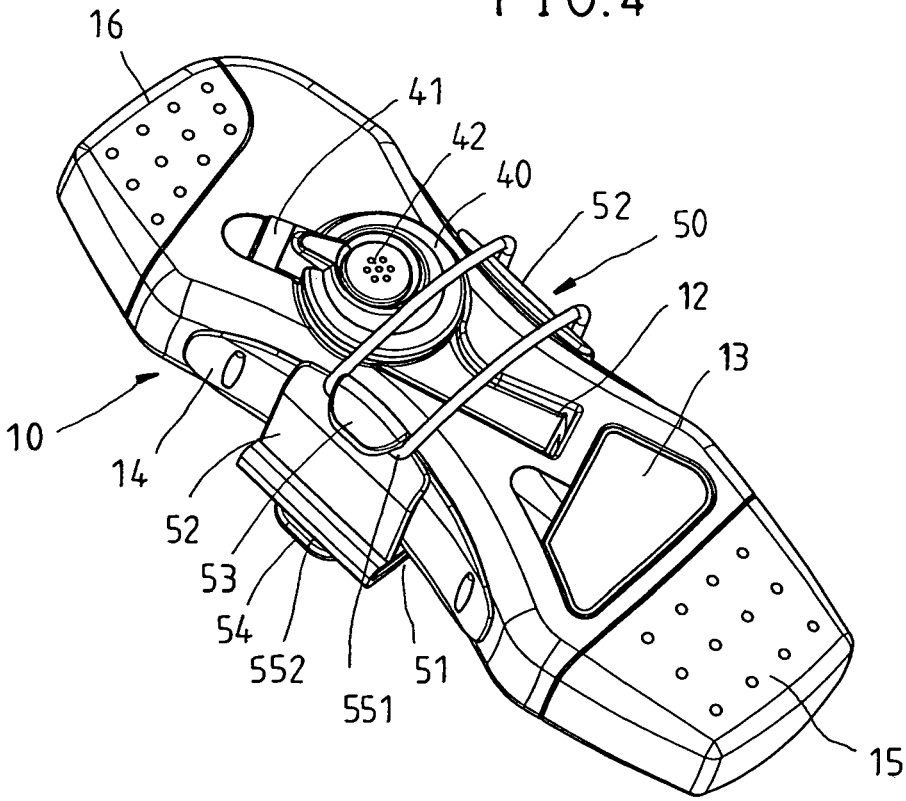
FIG. 5 is a back perspective view of the preferred embodiment of the present invention.

As shown in FIG. 3 to FIG. 5, the clip 50 has two bent inwards mounting portions 51. Under the mounting portions 51, the belt 100 runs through and the mounting portions 51 are provided with teeth to grip the belt 100. The clip 50 is provided with two arms 52 respectively on the mounting portions 51. The arms 52 are flexible to clip lateral sides of the main member 10. One of the arms 52 has a first hook 53 on a distal end thereof and a second clip 54 is provided on a back of the clip 50.

With the structure of the emergency escape tool as mentioned above, the tool of the present invention is fastened on the belt 100 of the vehicle such that the driver can reach the tool easily for escape during an emergency. The driver can cut the belt 100 off with the cutting device 30, break the window with the hammer 20, and call for help with the whistle 40. The cutting device 30 is provided on the main member 10 at the end opposite from the hammer 20 to prevent the cutting device 30 from damage while hammering the window by the hammer 20. The user grips the main member 10 with the hammer 20 extending out of the palm at the side of the little finger. Such a way of gripping the tool of the present invention decreases the distance of swing but still has enough power to break the window. The whistle 40 is provided with the light emitting device 42 so that the whistle has both functions of noise and lighting. The recess 11 of the main member 10 can store personal medicines and a personal information card including information such as blood type, personal disease history and so on.

What is claimed is:

1. An emergency escape tool, comprising:

a main member;

a cutting device having a blade which is provided on an end of the main member;

a hammer provided on the main member at an end opposite from the cutting device; and a clip detachably mounted on the main member to mount the main member on a belt, wherein the clip has two mounting portions bent inwards and two flexible arms to clip the main member at lateral sides thereof;

wherein a first hook is disposed on one of said mounting portions and a second hook is disposed on a back of said clip, and a holder has opposite ends thereof hooked by the first and second hooks respectively.

2. The emergency escape tool as defined in claim 1, wherein the main member has a hole in which a whistle is received.

3. The emergency escape tool as defined in claim 2, wherein the whistle is provided with a light emitting device.

4. The emergency escape tool as defined in claim 3, wherein the whistle is provided with a button to turn the light emitting device on and off.

5. The emergency escape tool as defined in claim 1, wherein the main member has a recess and a cover to close the recess.

6. The emergency escape tool as defined in claim 1, wherein the main member has two covers detachably mounted on the ends thereof to shield the cutting device and the hammer.

7. The emergency escape tool as defined in claim 1, wherein the hammer has an impacting portion that is substantially parallel to an elongated axis of the main member and the blade of the cutting device has a cutting portion that is substantially perpendicular to the elongated axis of the main member.

8. An emergency escape tool, comprising:

a main member;

a cutting device having a blade which is provided on an end of the main member;

a hammer provided on the main member at an end thereof opposite from the cutting device, and a clip detachably mounted on the main member, wherein the clip has two mounting portions bent inwards and two flexible arms to clip the main member at lateral sides thereof;

wherein a first hook is disposed on one of said mounting portions and a second hook is disposed on a back of said clip, and a holder has opposite ends thereof configured to be hooked by the hooks respectively.

9. The emergency escape tool as defined in claim 8, wherein the main member has a recess to receive goods therein.

10. The emergency escape tool as defined in claim 8, further comprising a whistle detachably mounted on the main member, wherein the whistle is provided with a light emitting device for lighting.

* * * * *